US005433409A

United States Patent [19]

Knopp

[11] Patent Number: 5,433,409

[45] Date of Patent: Jul. 18, 1995

[54] HEIGHT-ADJUSTABLE SUPPORT DEVICE, IN PARTICULAR FOR THE SEAT OF A CHAIR

[75] Inventor: Axel Knopp, Eitelborn, Germany

[73] Assignee: Stabilus GmbH, Koblenz-Neuendorf, Germany

[21] Appl. No.: 105,023

[22] Filed: Aug. 10, 1993

[30] Foreign Application Priority Data

Aug. 20, 1992 [DE] Germany ..... 42 27 553.9

[51] Int. Cl.[6] ..... F16M 11/00

[52] U.S. Cl. ..... 248/161; 248/188.7; 297/344.19

[58] Field of Search ..... 248/161, 188.7, 188.1; 297/344.19, 344.18, 344.1

[56] References Cited

U.S. PATENT DOCUMENTS

| | | | |
|---|---|---|---|
| 4,607,897 | 8/1986 | Schwartz | 248/188.7 X |
| 4,662,681 | 5/1987 | Favaretto . | |
| 4,744,536 | 5/1988 | Bancalari | 248/188.7 X |
| 4,756,496 | 7/1988 | Hosan | 248/161 |
| 4,899,969 | 2/1990 | Bauer | 248/161 |
| 5,039,164 | 8/1991 | Gibbs | 248/188.7 X |
| 5,131,615 | 7/1992 | Hosan | 248/161 |
| 5,149,035 | 9/1992 | Bonnema | 297/344.19 X |
| 5,161,786 | 11/1992 | Cohen . | |
| 5,284,312 | 2/1994 | Dony | 297/344.19 X |

FOREIGN PATENT DOCUMENTS

| | | | |
|---|---|---|---|
| 0133523 | 2/1985 | European Pat. Off. | 297/344.19 |
| 1961656 | 12/1966 | Germany . | |
| 8321916 | 11/1983 | Germany . | |
| 2095364 | 9/1982 | United Kingdom | 297/344.19 |

*Primary Examiner*—J. Franklin Foss
*Attorney, Agent, or Firm*—Brumbaugh, Graves, Donohue & Raymond

[57] ABSTRACT

The invention relates to a height-adjustable support device, in particular for the seat (12) of a chair (10), having a base (14) and an upright tube (16) disposed on the base vertically along a center axis (11) thereof, in which a height-adjustment element (18), preferably a gas spring, is arranged so as to be rotatably and/or vertically displaceably guided by a guide surface (34c) disposed concentrically to the center axis and so as to be supported on a support (28) in the lower end section of the upright tube (16). The guide surface (34c) and the support (28) are integrally-formed with the upright tube (16) itself, and the upright tube (16) and the base (14) are made in one-piece of a plastic material.

22 Claims, 3 Drawing Sheets

HEIGHT-ADJUSTABLE SUPPORT DEVICE, IN PARTICULAR FOR THE SEAT OF A CHAIR

BACKGROUND OF THE INVENTION

The invention relates to a height-adjustable support device for supporting a load-bearing surface, e.g., for the seat of a chair, having a base and an upright tube disposed thereon vertically along a center axis, in which a height-adjustment element, e.g., a gas spring, is arranged. The height-adjustable element is rotatably and/or vertically displaceably guided by at least one guide surface disposed concentrically to the center axis of the upright tube and is supported on a support in the lower end section of the upright tube.

THE PRIOR ART

Such a height-adjustable support device can be found in many modern pieces of furniture, e.g., in so-called office chairs. A rotatable office chair of this type, for example for the work station of a secretary, customarily consists of a base and a seat/backrest unit rotatably connected to the base, so that the user is able without difficulty to face in different directions, such as, for example, two work surfaces arranged at right angles to each other. Furthermore, the seat is customarily connected to the base via a so-called gas spring, i.e., a height-adjustment element, so that the chair can be adapted to users of different body heights or can be used at work surfaces disposed at a different heights.

As a rule, the base has the shape of a plurality—typically five—radially outward extending cross-pieces, on the ends of which rollers are disposed on which the chair is movable. A hub is customarily disposed in the center of the crosspieces for receiving a vertically arranged upright tube, with the connection between the hub and the tube typically being in the form of a press fit of two surfaces in the form of envelopes of a cone. In place of the rollers, all manner of legs can be imagined, such as are known from office chairs, side tables and object chairs, in particular also gliding bases and balls.

A guide bushing is customarily disposed in the upright tube held in the hub, in which the gas spring or the height-adjustment element is radially supported and guided in the vertical (axial) direction.

Prior art of this type is known from U.S. Pat. No. 4,756,496, for example. The '496 patent describes a height-adjustable support column for the seat of a chair that is constructed in the manner described and is connected with a base. Crosspieces forming the base are welded to a hub made from a metallic material, the inner surface of the upper end of which is conically diverging. An upright tube with a conically converging lower end is vertically seated in the hub by means of a press fit and has on its upper end a guide bushing made of a plastic material. The plastic guide bushing has an interior cylinder-shaped guide surface, against which the exterior surface of the gas spring is radially supported and vertically guided. The lower end of the piston rod of the gas spring rests on an axial bearing in the form of a ball bearing supported on a support plate held by the crimped lower end of the metallic upright tube. The gas spring is connected at its upper end to the seat structure of the chair via a connecting sleeve, also conically shaped to mate with a correspondingly-shaped conical surface on the seat structure.

The lifting device for a chair seat described in German Utility Model DE-GM 83 21 916.1 is of a similar construction and only differs from the previously mentioned support column by having an additional tube intended to make replacement of the gas spring easier.

A somewhat simplified construction is found in German Utility Model DE-GM 19 61 656, which discloses a support device for the seat of a chair in which the crosspieces of the base are welded directly to the upright tube, without a hub and a conical press fit being provided. As in the previously mentioned constructions, a plastic guide bushing is disposed in a metallic upright tube of this construction.

The employment of plastic materials during the course of manufacturing support devices of the type considered here has been known per se for a long time. Thus, it is known to insert a guide bushing of plastic into the upper end area of the upright tube with the aim of obtaining a frictionally advantageous guidance between the upright tube and the height-adjustment element. It is furthermore known to injection-mold a one-piece plastic base with a hub having an inner conical surface for receiving the upright tube provided with an outer conical surface. In this embodiment, however, for the reasons stated below the upright tube was again embodied as a separate metal part so that the construction was similar to that of U.S. Pat. No. 4,756,496 discussed above.

The reasons essentially were the following: With the separate production of the base and the upright tube there is a considerably lower outlay for molds for producing the base. Along with this cost advantage, chair manufacturers often want to use various designs for distinguishing their products over those of the competition, which in itself already entails high costs for molds. The opportunity for injection-molding the base without the upright tube and to connect it with an upright tube by means of a conical fit was therefore taken up by chair manufacturers, because by so doing it was possible to lower mold costs for the base and, in addition, to increase the variety of the designs by the combination of a few bases, on the one hand, and upright tubes, on the other. Another reason for the separate production of the base and subsequent connection of the base with a separately produced upright tube was that it reduced the cargo space required for shipments from the injection-molding factory to the chair producer and in this way saved transport and storage costs.

Another reason was that it was already possible, by means of the production of the separate base and the upright tube inserted into the base, to adapt the separate parts individually to the various functions in the production phase in an optimal way in respect to the choice of materials and processing technology. It was also desirable for the chair producers to be able to combine different colors or surface designs in an attractive manner because of the separate production of the base and the upright tube.

In light of these reasons for the combination of a plastic injection-molded base and a separately produced (and in particular metallic) upright tube, the prior art has led away from the production of the base and the upright tube as a one-piece structure.

SUMMARY OF THE INVENTION

It is an object of the invention to embody the guide surface and the support for the height-adjustment element on the upright tube itself and to mold the upright tube and the base of plastic as unitary, one-piece structure.

An essential advantage of this one-piece base-tube structure is that it provides increased stability with decreased outlay of material. The reason for this is that the upright tube, which must be relatively stiff in view of the bending loads thereon and must therefore be made with strong walls, if connected in one-piece with the crosspieces of the base can take over a considerable portion of the transfer of forces, which up to now have been taken over by the separate hub.

Furthermore, with the one-piece construction of the base and the upright tube there is the possibility by means of ribbing to increase simultaneously the flexural strength of the base, the connective strength between the base crosspieces and the upright tube and the flexural strength of the upright tube itself with a relatively small outlay of materials. It has been shown that, at least in certain classes of products, these surprisingly obtained advantages surpass the aforementioned advantages which are realized from making the base and the upright tube as separate parts.

In accordance with the invention, the upright tube may take various configurations, including simply a massive, annular-cylindrical wall the interior circumferential surface of which constitutes the guide surface. In a preferred embodiment, the upright tube is made with an exterior shell on the inside of which the guide surface is formed by a plurality of structurally elastic guide elements made of one-piece with the exterior shell. This embodiment, in combination with the one-piece design of the crosspieces with the upright tube, results in the important additional advantage that the exactitude of fit between the upright tube and the height-adjustment element guided therein becomes less critical. Thus, for example, the exterior circumferential surface of the height-adjustment element resting against the guide surface can be produced with a certain oversize and in this way always assure within an acceptable tolerance range a snug, wiggle-free bearing of the height-adjustment element against the guide surface. To that end, the guide elements on the interior of the upright tube should be structurally elastic in the radial direction. If, because of a load on the chair, large forces are transmitted from the crosspieces of the base to the upright tube, when economizing with materials it would not be inconceivable that in the upper connection area of the crosspieces with the upright tube there would be an elastic contraction of the upright tube in the circumferential direction, and in the lower connection area of the crosspieces with the upright tube there would be an elastic expansion of the upright tube in the circumferential direction. The guidance properties between the upright tube and the height-adjustment element could be negatively affected by this. By forming the guide surface as radially structurally elastic guide elements formed of one-piece on the inside of the exterior shell of the upright tube, a possible elastic deformation of the upright tube because of the introduction of forces from the direction of the crosspieces can be compensated to a large extent by the radially elastic compression of the guide elements.

A particularly preferred embodiment of the guide elements results when the upright tube is formed with a plurality of segmented arcuate guide elements, the geometric basic shape of which is a circular-cylindrical envelope section limited respectively by two cylindrical generating lines, which are disposed parallel to the center axis.

In this embodiment, it is possible to achieve the radial elasticity between the guide elements and the exterior shell, on the one hand, by appropriate radii of curvature of the circular-cylindrical envelope sections and, on the other hand, by a corresponding support of the arcuate guide segments on the exterior shell. In a preferred manner, the radius of curvature of the circular-cylindrical envelope section in the area of the guide surfaces defined thereby, i.e., at the inner surface where contact is made with the height-adjustment element, is selected to be slightly less than the radius of curvature of the adjoining cylindrical surface of the height-adjustment element.

In accordance with a preferred embodiment, the guide surfaces defined by the segmented arcuate guide elements are respectively the inner surface of a section of a tube wall which is cut out in the shape of a sector of a circle and which is respectively connected by a bar or rib to the internal wall of the upright tube.

The base can be formed by crosspieces extending radially outward from the outside of the upright tube. In this connection, the methods of casting technology, extrusion technology or molding technology used for production permit the attachment of the crosspieces to the upright tube at an arbitrary height and—looking at this in a plane containing the axis of the upright tube and the respective crosspiece—to lend the crosspiece an arbitrary shape, taking into consideration static and design-specific points. This is a particular advantage over the known separate hub solution, where for reasons of production technology it was necessary to connect the hub with the upright tube at the lower end area of the tube, so that, taking the total height into consideration, the crosspieces had to extend radially outward in an essentially horizontal direction.

According to a further feature of the invention, the crosspieces may be connected to the outside of the upright tube via stiffening ribs. Appropriately designed, the stiffening ribs can be simultaneously used as design elements. They not only strengthen the transition between the crosspieces and the upright tube, while reducing concentrations of tension, but at the same time increase, with small additional material outlay, the guidance stability of the upright tube during eccentric stresses on the chair. These stiffening ribs can be provided in the respectively lower connection areas as well as in the respectively upper connection areas of the crosspieces to the upright tube.

The one-piece production of the upright tube with the base also permits the adaptation of the wall thickness of the upright tube along its height to the respectively expected loads. In particular, it becomes possible to let the wall thickness decrease toward the top without a loss of stability. The methods of plastic manufacture, e.g., injection molding, furthermore permit adjoining crosspieces to be connected by means of a stiffening rib or ribs extending between them. These latter stiffening ribs add to the stability by limiting the springiness of successive crosspieces in relation to each other in the circumferential direction.

The unitary molded plastic part comprising the base and the upright tube can be made of various thermoplastic and duroplastic materials. Examples of thermoplastic materials are: polyoxi- methylene, polyamide, polytetrafluoroethylene, etc.; examples of duroplastic materials are: polyester resin and epoxy resin.

The plastics can be loaded with the conventional reinforcing materials, such as textiles, metal or glass fibers for example, to increase sturdiness.

BRIEF DESCRIPTION OF THE DRAWINGS

Preferred embodiments of the invention are described in detail below, with reference to the drawings, in which.

DETAILED DESCRIPTION OF PREFERRED EMBODIMENTS

Figure 1:
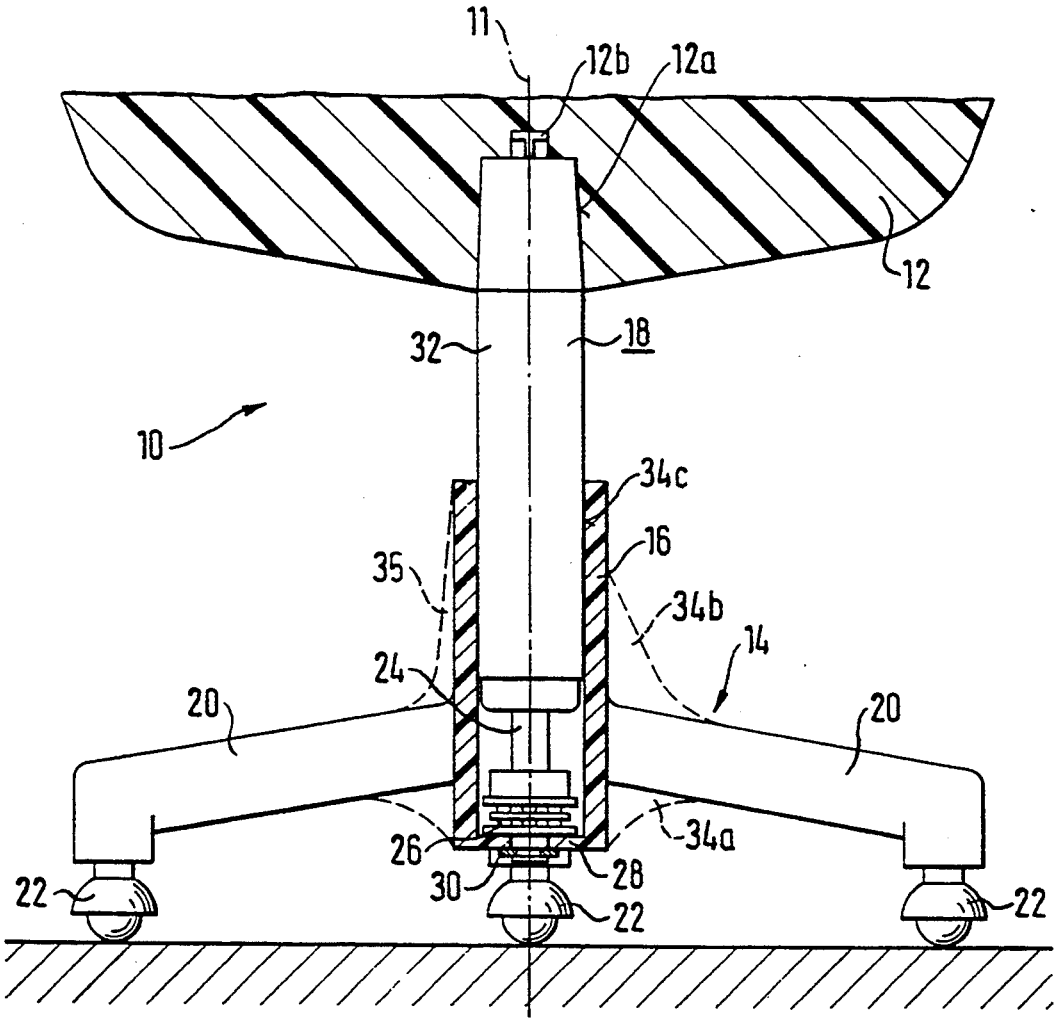
FIG. 1 a vertical section through a rotatable office chair with a support device in accordance with the invention.
Figure 2:
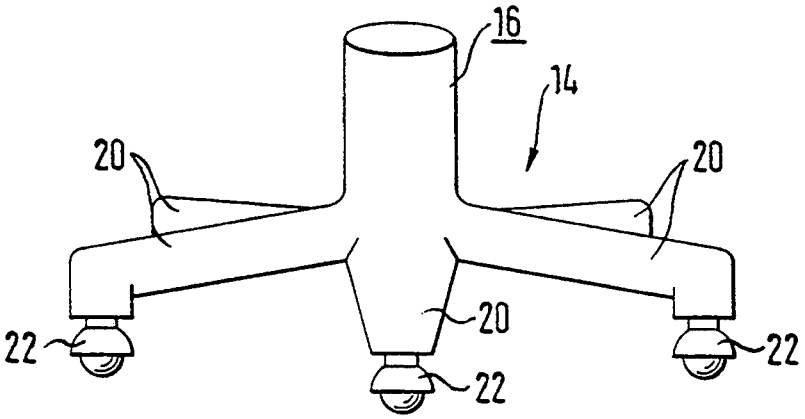
FIG. 2 a perspective view of a base in accordance with the invention with the one-piece upright tube.

The rotatable office chair 10 illustrated in FIG. 1 has a seat 12, which is supported by a height-adjustable support device including a base 14, an upright tube 16 disposed centrally and vertically thereon, and a height-adjustment element in the form of a gas spring 18. As can be seen in the perspective view of FIG. 2, the base 14 has five crosspieces 20, which are made of one-piece, unitary construction with the upright tube 16 and extend from its lower end radially outward and down. Sliding runners or rollers 22, with which the base rests on the floor, are attached at the outer ends of the crosspieces 20.

The gas spring 18 has a piston rod 24 extending vertically downward and supported via an axial roller bearing 26 on the support 28. The lower end of the piston rod 24 extends with radial play through an axial bore in the support 28 and is connected by means of an interlocking safety element 30 to the side of the support 28 facing away from the axial roller bearing, so that the gas spring is captured within the upright tube 16 and will not be pulled out of the tube 16 when the chair is lifted by the seat 12. The support 28 is embodied as an annular wall made of one-piece with the upright tube 16. The seat 12 is fastened on the upper end of the gas spring by means of a pair of cone-shaped surfaces 12*a*. The construction of the gas spring 18, its fastening on the support 28 and its connection with the seat 12 are shown in more detail in FIG. 1 of U.S. Pat. No 4,756,496. FIG. 1 of the '496 U.S. patent also discloses a mechanical release device which is not shown here, but can easily be used by the chair occupant to actuate a release pin 12*b*. The gas spring is equipped with a pneumatic locking device such as described in the '496 patent. The release pin 12*b* is used to block the pneumatic adjustment device or to release it for a height-adjustment of the gas spring. The foregoing portions of the '496 patent are hereby incorporated by reference.

Figure 3:
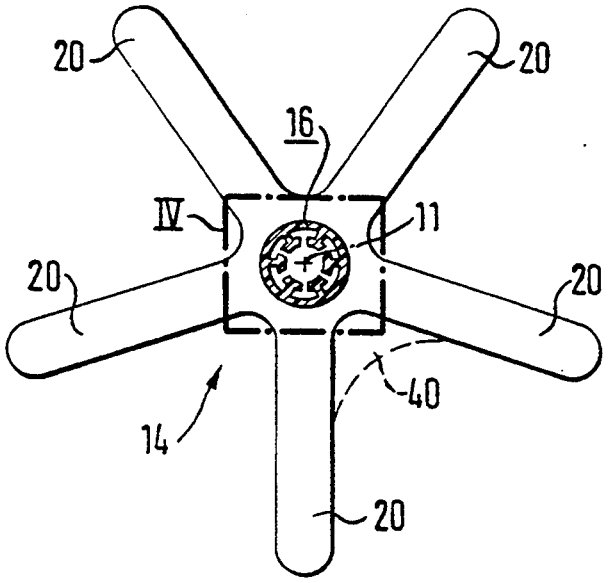
FIG. 3 a horizontal section through the base with the upright tube shown in FIG. 2.

The upper portion of the gas spring, i.e. the pressurized cylinder, is surrounded by a protective tube 32, which is also illustrated in U.S. Pat. No. 4,756,496. However, this protective tube can also be omitted if desired. The outer surface of the protective tube 32 (or the gas spring cylinder if the tube 32 is omitted) rests against the inside of the upright tube 16, which defines the guide surface 34*c* for the gas spring. The guide surface 34*c* can be embodied in various ways. An exemplary embodiment is shown in FIG. 3 and will be described later.

If the user of the chair rotates the seat 12, the height-adjustment device (gas spring 18) connected with it also rotates, in which case the outside of the protective tube 12 is rotationally guided by the guide surface 34*c*. Along with the gas spring 18, the piston rod 24 also turns on the axial roller bearing 26.

If the user of the chair actuates the actuating device for the height-adjustment (not shown), the upper part (cylinder) of the gas spring 18 is lifted by the gas pressure, so that it moves upward in relation to the piston rod 24. The guide surface 34*c* guides the outer surface of the protective tube 12 in such axial movement. If the user of the chair actuates the actuating device (not shown) while seated on the seat 12, the upper part of the gas spring 18 is pushed downward because of the weight of the user's body. The outer surface of the protective tube 32 is again guided in the axial direction by the guide surface 34*c*.

The force of the weight of the user is transmitted to the upright tube 16 via the gas spring 18 and its piston rod 24 and the support 28 connected with the upright tube 16. The crosspieces 20 embodied in one-piece with the upright tube 16 are stressed by bending, the highest stresses occurring at the transitional cross section between the crosspieces 20 and the upright tube 16. Because of the one-piece construction provided in accordance with the invention, it is possible to utilize the entire thickness of the upright tube wall for an advantageous transfer of the stresses and, furthermore, to make the connecting cross sections between the crosspiece 20 and the upright tube 16 large, for example by extruded or cast stiffening ribs 34*a*, 34*b*, as indicated by the dashed lines in FIG. 1.

If a user sits off-center on the seat structure 12, bending stresses occur in the height-adjustment element (gas spring) 18 and are transmitted therefrom to the upright tube 16. As suggested by the dashed line 35 in FIG. 1, the cross section of the upright tube 16 can be shaped to increase from top to bottom, for example in the shape of a parabola, so that the same bending stresses occur in all cross sections and the safety of the upright tube against failing is increased, while at the same time having an attractive exterior. The one-piece manufacture of the base 14 and the upright tube 16 from a plastic material makes new shapes possible, for which there has been a long-standing need in the furniture industry for reasons of esthetics as well as stability.

Figure 4:
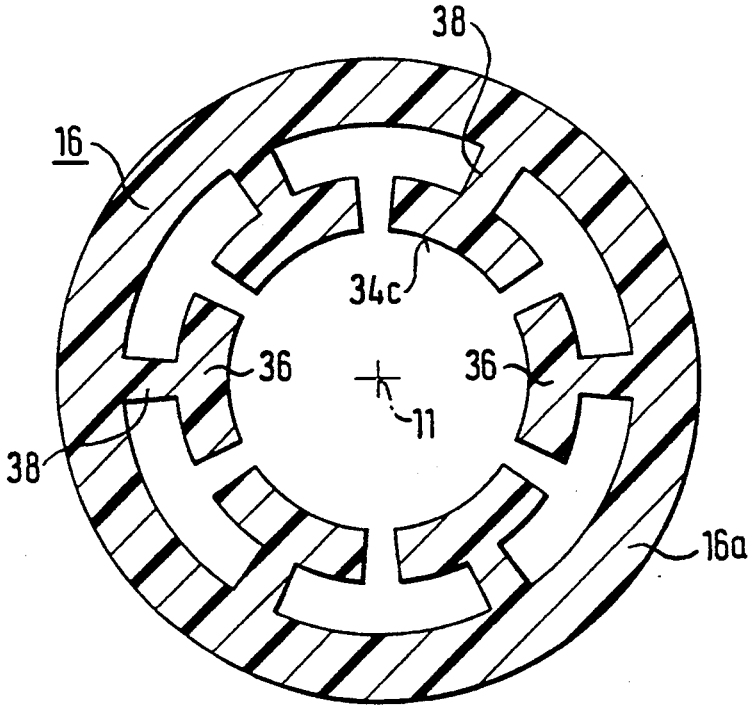
FIG. 4 a section on an enlarged scale through the upright tube shown in FIG. 3.

FIG. 4 shows a section on an enlarged scale through an upright tube 16 with segmented arcuate guide elements 36 defining the guide surface 34*c*. In the exemplary embodiment illustrated in FIG. 4, six segmented guide elements 36 are disposed concentrically around the center axis 11 and together form a circular cylinder envelope interrupted by vertical slits. The guide surface 34*c* is defined by the inner surfaces of the guide elements 36, which elements are connected via vertically extending bars or ribs 38 to the exterior shell 16*a* of the upright tube 16. The guide elements 36 have the shape of a tube wall section cut out in the form of a sector of a circle. As can be seen in FIG. 1, the guide surface 34*c* preferably extends at least over the entire length of stroke of the height-adjustment element 18, so that a large support surface for the force transfer between the outer surface of the protective tube 32 and the guide surface 34*c* is provided, because of which surface pressure between the tube and the height-adjustment element 18 is reduced. In this way, it is possible to achieve low coefficients of friction, and thus reduced frictional forces, with plastics. The connection, shown in FIG. 4, of the guide elements 36 and ribs 38 to the exterior shell 16*a* of the upright tube 16 offers the advantage that the guide elements 36 do not require resilient post-treatment if the entire component, consisting of the base 14, the upright tube 16 and the integrated guide surface 34*c* and the support 28 is taken from an injection molding tool, for example. The reason for this is that the described connection of the guide-surface defining guide elements 36 to the upright tube 16 by means of the ribs 38, made in one-piece from plastic, provides a certain amount of elasticity so that, compared with the coupling of two metallic materials, it is possible to permit comparatively large tolerances. The guide surface 34*c* can also be made or improved by mechanical re-working, if desired.

As suggested by the dashed line 40 in FIG. 3, adjoining crosspieces 20 can be connected by a stiffening rib extending essentially horizontally between them. In FIG. 1 it can be seen that the lower end of the upright tube 16 extends downward considerably below the crosspieces 20. To make the existing molded piece less awkwardly shaped to the greatest extent, while at the same time always assuring a guided length sufficient for the full stroke of the height-adjustment, the end of the upright tube 16 is permitted to extend as far as possible downward, for example to approximately 30 mm above floor height.

For the first time, the unitary construction of the base, the upright tube, the guide surface and the support of the height-adjustment element of the invention make possible a construction which provides correct stresses specifically in connection with plastic material in a component suitable for large-size mass production, and opens new design possibilities also from an esthetic viewpoint.

I claim:

1. A height-adjustable support device for supporting a loadbearing surface comprising a base adapted to be supported on a floor surface and an upright tube disposed on the base and having a vertical center axis, an adjustable-length assembly coupled at its upper end to the load-bearing surface and coupled at its lower end to a support adjacent to the lower end of the upright tube, the adjustable-length assembly including a piston rod unit and a housing unit, said piston rod unit being coupled to said support and the housing unit being vertically displaceably guided by a guide surface of the tube and disposed concentrically to the center axis of the guide tube, the guide surface and the support being unitary parts of the upright tube, the upright tube and the base being a single, unitary component made of a plastic material, and said housing unit being in direct sliding contact with said guide surface.

2. A support device in accordance with claim 1, wherein the upright tube has an exterior shell, and the guide surface includes circumferentially spaced-apart structurally-elastic guide elements integrally formed with and located within the exterior shell.

3. A support device in accordance with claim 2, wherein each guide element includes an arcuate segment, the geometrical basic cross sectional shape of which is a segment of a circular-cylindrical envelope section defined by two generating lines parallel to the center axis, and the inner surfaces of said arcuate segments together defining said guide surface.

4. A support device in accordance with claim 3, wherein the guide surface has a length in the axial direction which is at least as long as the stroke of the length-adjustable element within the upright tube.

5. A support device in accordance with claim 3, wherein each arcuate segment comprises a section of the tube wall which is cut out in the shape of a sector of a circle and which is connected by a radially-extending rib to the inner wall of the upright tube.

6. A support device in accordance with claim 1, wherein the base includes crosspieces extending outwardly from the outside of the upright tube in vertical planes containing the axis of the upright tube.

7. A support device in accordance with claim 6, and further comprising stiffening ribs of said plastic material unitary with and connecting the crosspieces with the outside of the upright tube.

8. A support device in accordance with claim 6, wherein the wall thickness of the upright tube increases progressively from the upper end of thereof to the junctures between the crosspieces and the upright tube.

9. A support device in accordance with claim 6, wherein at least two adjacent crosspieces are interconnected by an integrally-formed stiffening rib extending therebetween.

10. A support device in accordance with claim 1, wherein the surfaces of the base resting on the floor are made in one piece from the plastic material of the base and the upright tube.

11. A support device in accordance with claim 1, wherein the base includes means for fastening sliding or rolling elements thereon for engagement with the floor.

12. A support device in accordance with claim 1, wherein the height-adjustment assembly is a cylinder-piston device having a cylinder and a piston rod having a portion extending out of the cylinder in the direction of axis of the upright tube, the piston rod is rotatably supported with at outer end on the support of the upright tube by means of a roller bearing; and the cylinder is guided in a rotatable and height-adjustable manner by the guide surface.

13. A support device in accordance with claim 12, wherein the cylinder-piston device has on the end thereof opposite the piston rod a release member for a locking device.

14. A support device in accordance with claim 1, wherein the load-bearing surface is the seat of a chair.

15. A support device in accordance with claim 1, wherein the adjustable-height assembly is a pressurized gas spring.

16. A support device in accordance with claim 1, wherein the base includes a plurality of crosspieces extending outwardly from the outside of the upright tube in vertical planes approximately containing the center axis of the upright tube, said crosspieces having respective radially inner end portions adjacent said upright tube and respective radially outer end portions adapted for being supported by the floor surface, said upright tube has a lower end and an upper end and a vertical center equidistant from the lower and upper ends, and said crosspieces are joined to the upright tube at junctures located below the vertical center.

17. A support device in accordance with claim 2, wherein the wall thickness of the upright tube increases progressively from the upper end to the lower end.

18. A support device in accordance with claim 2, and further comprising stiffening ribs of said plastic material extending between and unitary with said radially inner portions of said crosspieces and the upper end of said upright tube.

19. A support device in accordance with claim 4, wherein said stiffening ribs are of progressively decreasing widths radially with respect to the center axis and upwardly with respect to the crosspieces.

20. A support device in accordance with claim 2, wherein the junctures of the crosspieces with the upright tube are spaced apart from the lower end of the upright tube, and further comprising stiffening ribs of said plastic material extending between and unitary with said radially inner portions of said crosspieces and the lower end of said upright tube.

21. A support device in accordance with claim 20, wherein said stiffening ribs are of progressively decreasing widths radially with respect to the center axis and downwardly with respect to the crosspieces.

22. A support device in accordance with claim 6, wherein the crosspieces have integral downwardly directed support faces, said support faces defining a substantially horizontal virtual support plane located below the lower end of the upright tube.

* * * * *

UNITED STATES PATENT AND TRADEMARK OFFICE

CERTIFICATE OF CORRECTION

PATENT NO. : 5,433,409

DATED : July 18, 1995

INVENTOR(S) : Axel Knopp

It is certified that error appears in the above-indentified patent and that said Letters Patent is hereby corrected as shown below:

Col. 1, line 30, "at a" should read --at--;
Col. 8, line 18, "end of" should read --end--;
Col. 8, line 36, "at outer" should read --an outer--.

Signed and Sealed this

Twenty-fourth Day of October, 1995

*Attest:*

Bruce Lehman

BRUCE LEHMAN

*Attesting Officer*

*Commissioner of Patents and Trademarks*